United States Patent [19]

Edwards

[11] 4,241,591

[45] Dec. 30, 1980

[54] AIR CONDITIONING SYSTEM EMPLOYING DUAL CYCLE

[75] Inventor: Thomas C. Edwards, Cocoa Beach, Fla.

[73] Assignee: The Rovac Corporation, Rockledge, Fla.

[21] Appl. No.: 60,635

[22] Filed: Jul. 25, 1979

[51] Int. Cl.[3] ..... F25D 9/00

[52] U.S. Cl. ..... 62/402; 62/475

[58] Field of Search ..... 62/402, 475, 85, 86

[56] References Cited

U.S. PATENT DOCUMENTS

| | | | |
|---|---|---|---|
| 3,904,327 | 9/1975 | Edwards et al. | 418/13 |
| 3,913,351 | 10/1975 | Edwards et al. | 62/87 |
| 3,967,466 | 7/1976 | Edwards et al. | 62/87 |

*Primary Examiner*—Ronald C. Capossela

*Attorney, Agent, or Firm*—Leydig, Voit, Osann, Mayer & Holt, Ltd.

[57] ABSTRACT

An air conditioning unit including a compressor-expander employing a vaned rotor defining enclosed compartments which become smaller in the compressor and larger in the expander as the shaft rotates, for positive compression and expansion. A primary heat exchanger having an associated separator-sump is connected between the compressor outlet port and the expander inlet port for dissipation of heat. A secondary heat exchanger is connected between the expander outlet port and compressor inlet port for absorption of heat and to complete a closed loop. The loop is charged with a main refrigerant in the form of a non-condensing gas, such as air, plus an auxiliary refrigerant mixed with oil, the auxiliary refrigerant being chosen (a) to have appreciable heat of vaporization and (b) to be capable of liquifaction at the pressure and temperature existing in the primary heat exchanger and evaporation at the pressure and temperature existing in the secondary heat exchanger. A spray nozzle, fed from the sump via a first conduit, is provided at the inlet of the secondary heat exchanger so that droplets of auxiliary refrigerant are sprayed into the gas discharged from the expander for vaporization in the secondary heat exchanger. A booster pump is optionally used to feed a stream of auxiliary refrigerant, plus oil, from the sump to the unit via a second conduit for purposes of lubrication and cooling.

25 Claims, 11 Drawing Figures

80
63
HX2
66
64
87
V
T
89
ENCLOSED SPACE
31
40
34
51
M
41
42
50
48
2
43
47
2
44
46
45
30
32
33
87
SEE FIG'S. 5 & 6
112
116'
116
P
117
100 (PATH IN ROTOR)
101
102
86
113
61
65
115
HX1
62
78
73
72
70
74
114
71
75
88
86

63a
HX2
66a
161
64a
167
160
163
166
165
ENCLOSED SPACE
CLOSED WHEN RHx USED
162
164
A
RHx
31a
30a
80a
40a
34a
89a
87a
174
172
173
171
B
41a
42a
50a
48a
9
47a
43a
46a
M
51a
44a
45a
112a
32a
33a
116a
61
HX2
65a
TO A
FROM B
75a
TO SECOND BEARING
101a
50a
112a
78a
62a
73a
72a
CLOSED WHEN RHx USED
70a
74a
71a
88a
86a

63b
HX2
66b
64b
161b
167b
160b
166b
165b
163b
ENCLOSED SPACE
162b
164b
87b
A
RHX
CLOSED
WHEN RHX USED
V
VT
80b
89b
112b
31b
CT
ET
34b
86b
173b
174b
172b
171b
B
M
51b
32b
33b
61b
HX1
65b
TO A
FROM B
75b
78b
62b
73b
72b
CLOSED
WHEN RHX USED
70b
74b
71b
88b
86b

AIR CONDITIONING SYSTEM EMPLOYING DUAL CYCLE

In my prior U.S. Pat. No. 3,913,351 which issued Oct. 21, 1975 an air conditioning system is disclosed, employing a non-condensing gas such as air as the refrigerant, having a compressor-expander in which moisture is added to the air entering the expander to reduce the driving requirement, and to increase coefficient of performance, by increasing recovery of the work of expansion. In my subsequent U.S. Pat. No. 3,967,466 which issued July 6, 1976 a system is disclosed which includes means for spraying moisture in gross amount into the air entering the compressor in order to reduce the work of compression to bring about a further reduction in driving requirement and further increase in coefficient of performance.

It is the object of the present invention to bring about a still further decrease in driving requirement and a still further increase in coefficient of performance by utilizing, in combination with a main refrigerant in the form of a non-condensing gas, an auxiliary refrigerant having appreciable heat of vaporization and capable of liquifaction at the pressure and temperature existing in the primary heat exchanger, with the liquid refrigerant, instead of passing through the expander, being sprayed into the loop at the inlet of the secondary heat exchanger where vaporization occurs to produce additive cooling effect. Thus it is an object to provide an air conditioning unit having a refrigeration loop filled with a combination of non-condensing and condensing gases, operating in respective reverse-Brayton and reverse-Rankine cycles, to produce a cumulative cooling effect which substantially increases the cooling capacity and coefficient of performance of the unit.

It is another object of the present invention to provide improved means for separating the condensing refrigerant from the non-condensing refrigerant so that all of the non-condensing refrigerant passes through the expander and so that substantially all of the condensing refrigerant is bypassed around the expander for spraying and vaporization in the secondary heat exchanger.

It is yet another object of the present invention to provide an air conditioning unit employing both condensing and non-condensing refrigerants in which the condensing refrigerant, in liquid form, with addition of oil, forms a lubricating fluid which is circulated through passages in the frame and rotor of the unit to bring about efficient lubrication and cooling thereof.

It is a more detailed object of the present invention to provide means for conducting liquified auxiliary refrigerant, plus oil, through first and second conduits to the spray head and lubrication path, respectively, with concentrating means being interposed in the conduits for increasing the proportion of auxiliary refrigerant in the first conduit and increasing the proportion of oil in the second so that the respective functions are carried out with maximum efficiency.

Thus it is an object to provide an air conditioning unit of the above type in which the lubricant is transported by the liquified auxiliary refrigerant, the latter acting as a carrier for lubricating and cooling purposes, and in which the liquid refrigerant is metered by a booster pump of the positive displacement type for flowing at an optimum rate notwithstanding the back pressure which may exist in the unit.

It is, in this connection, an object to provide a system including a booster pump which not only pressurizes the lubricating conduit but which also pressurizes the conduit which conducts liquified refrigerant to the spray nozzle to increase the completeness of vaporization by reduction in droplet size.

It is an object of the invention in one of its aspects to bring about a still further improvement in operation by spraying of liquid auxiliary refrigerant from the sump directly into the inlet of the compressor.

It is a general object of the present invention to provide an air conditioning system which is highly compact, that is, which has an unusually high heat rate on either a volumetric or weight basis, a system which is capable of operating reliably and without maintenance for long periods of time, a system which is highly efficient in terms of driving requirement and coefficient of performance and a system which is flexibly and universally applicable to all air conditioning requirements, including domestic and industrial, fixed or automotive.

Other objects and advantages of the invention will become apparent upon reading the attached detailed description and upon reference to the drawings in which:

FIG. 1 is a diagram showing the components employed in a typical air conditioning system embodying the present invention.

Figure 2:
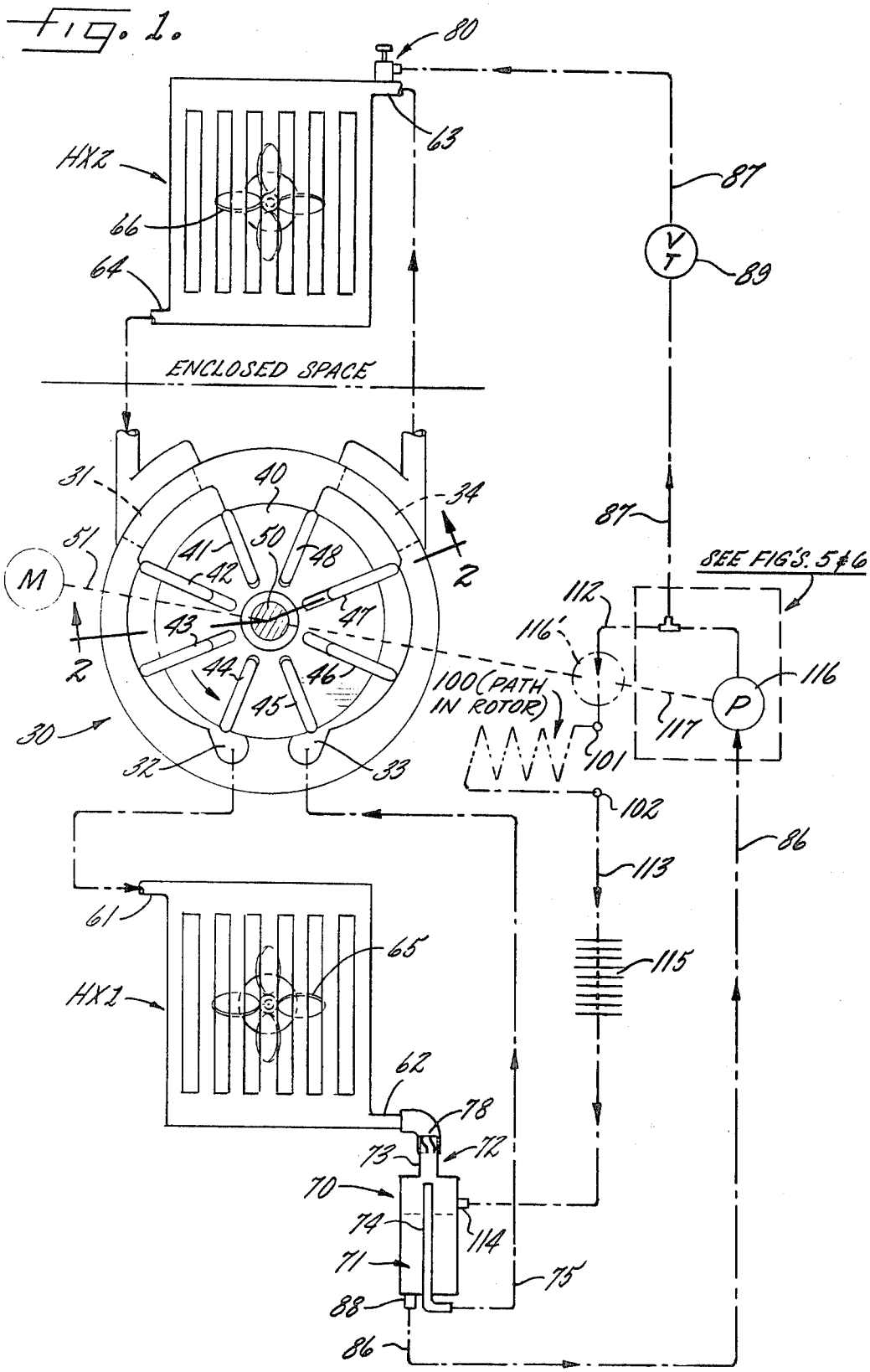
FIG. 2 is an axial section looking along line 2—2 of the compressor-expander in FIG. 1 to illustrate the path of the lubricating-cooling fluid.
Figure 2:
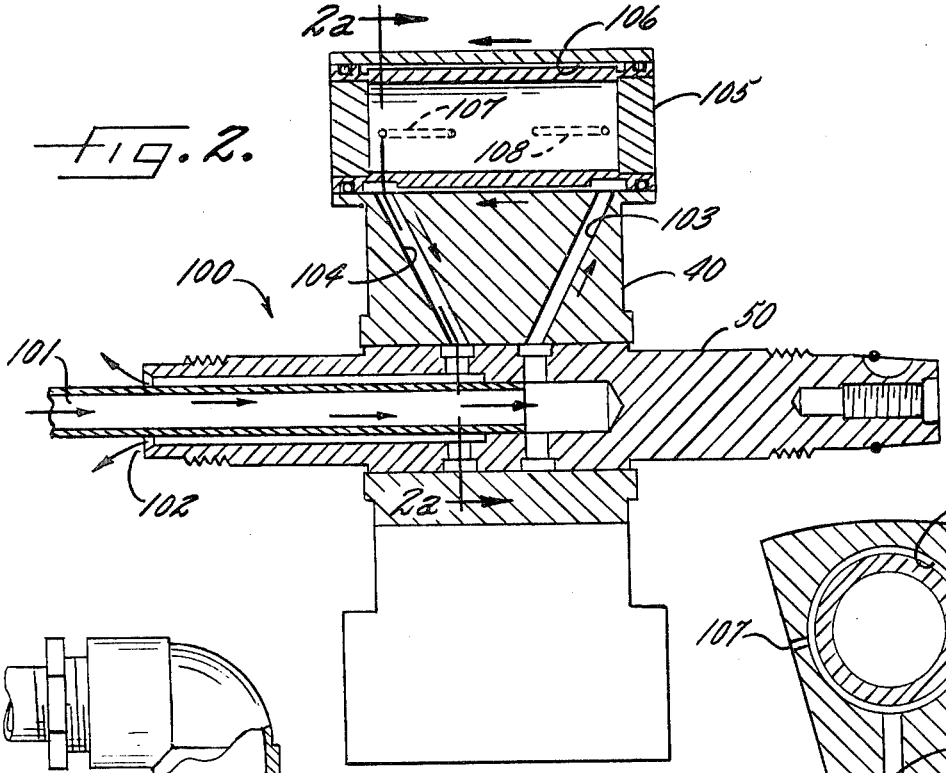
Figure 2A:
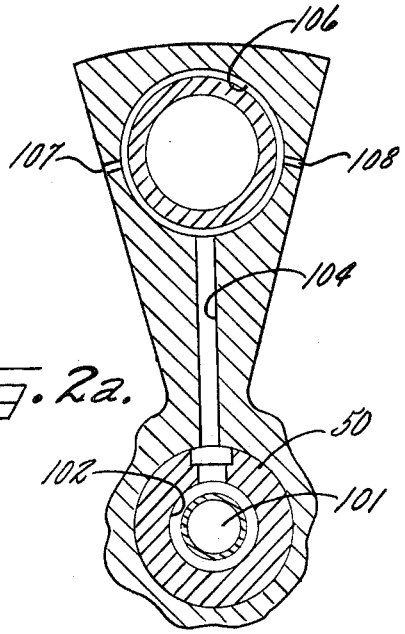

FIG. 2*a* is a fragmentary transverse section taken along line 2*a*—2*a* of FIG. 2.

Figure 3:
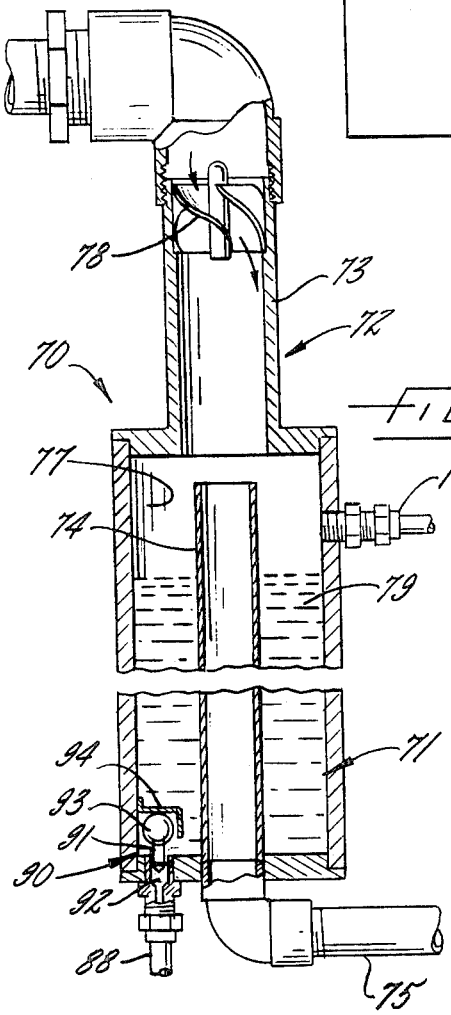

FIG. 3 is an enlarged vertical section taken through a preferred type of separator-sump.

Figure 4:
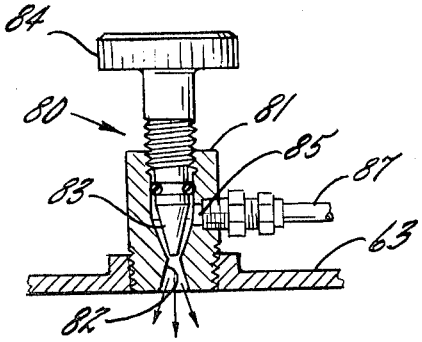

FIG. 4 is a fragmentary section taken through a typical spray valve of the adjustable type utilized in the present invention.

Figure 5:
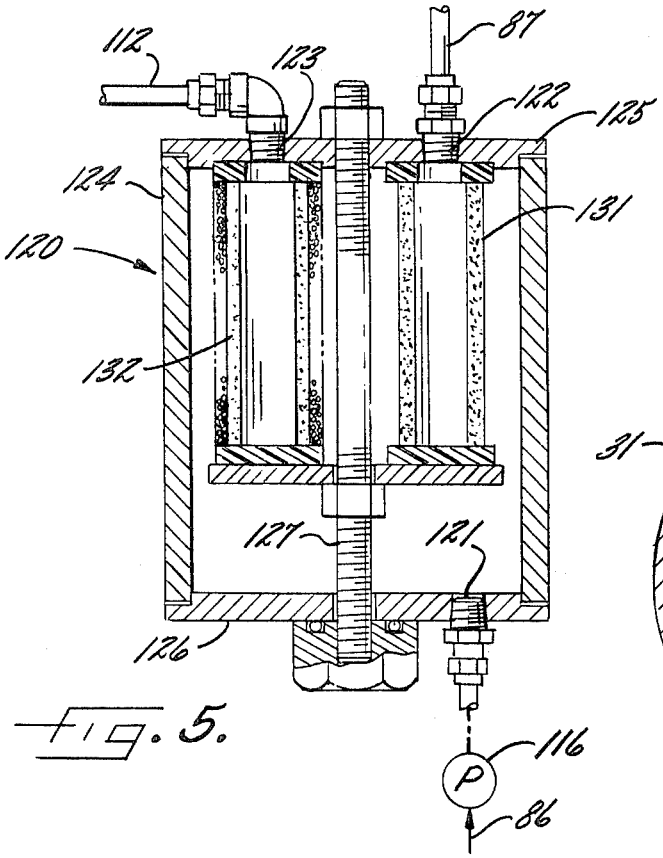

FIG. 5 shows one form of concentrating means employed in the system of FIG. 1 for increasing the relative proportions of refrigerant and oil fed into the spraying and lubricating conduits, respectively.

Figure 6:
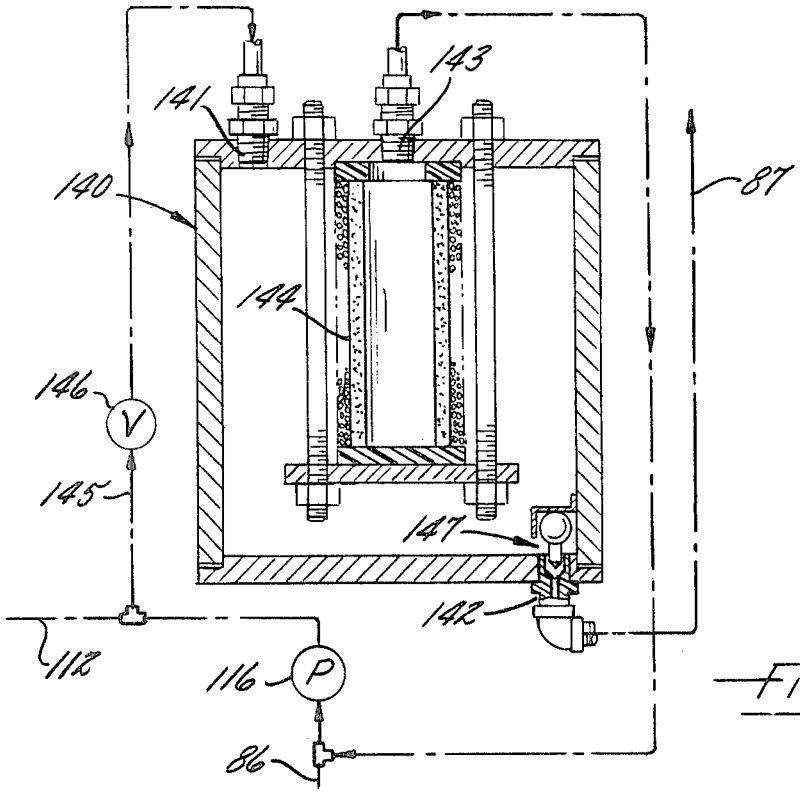

FIG. 6 shows diagrammatically an alternate form of concentrating means.

Figure 7:
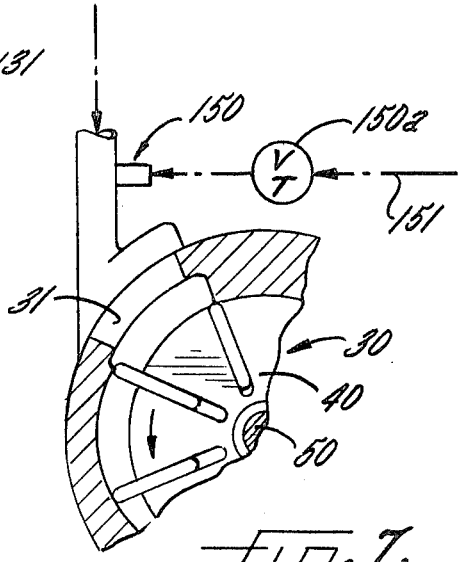

FIG. 7 shows spraying of liquid auxiliary refrigerant into the compressor inlet.

Figures 8, 9:
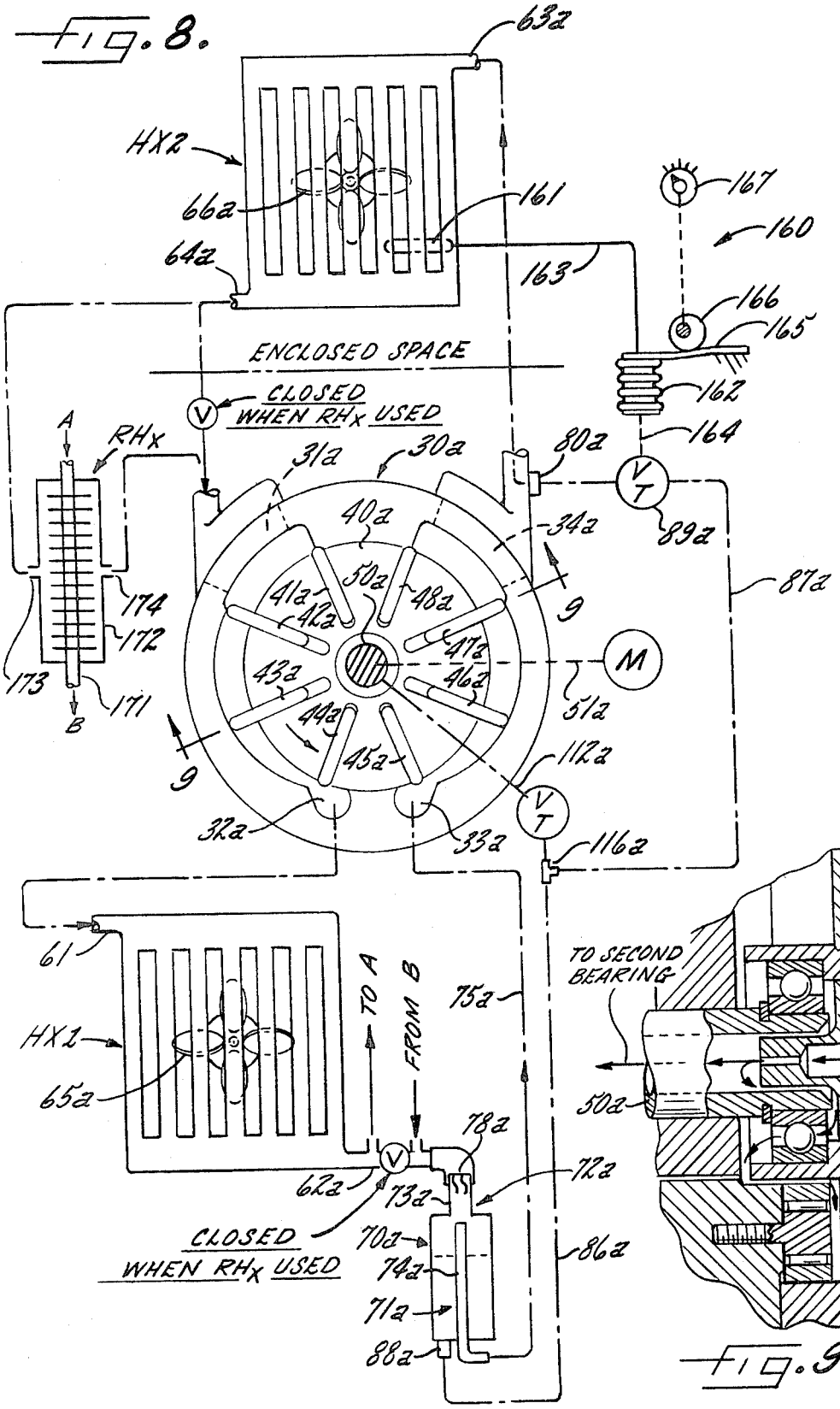

FIG. 8 is a diagram showing a modification of the system of FIG. 1.

FIG. 9 is a fragmentary axial section taken along line 9—9 of FIG. 8 showing introduction of liquid refrigerant into the unit from the sump for lubrication and/or cooling.

Figure 10:
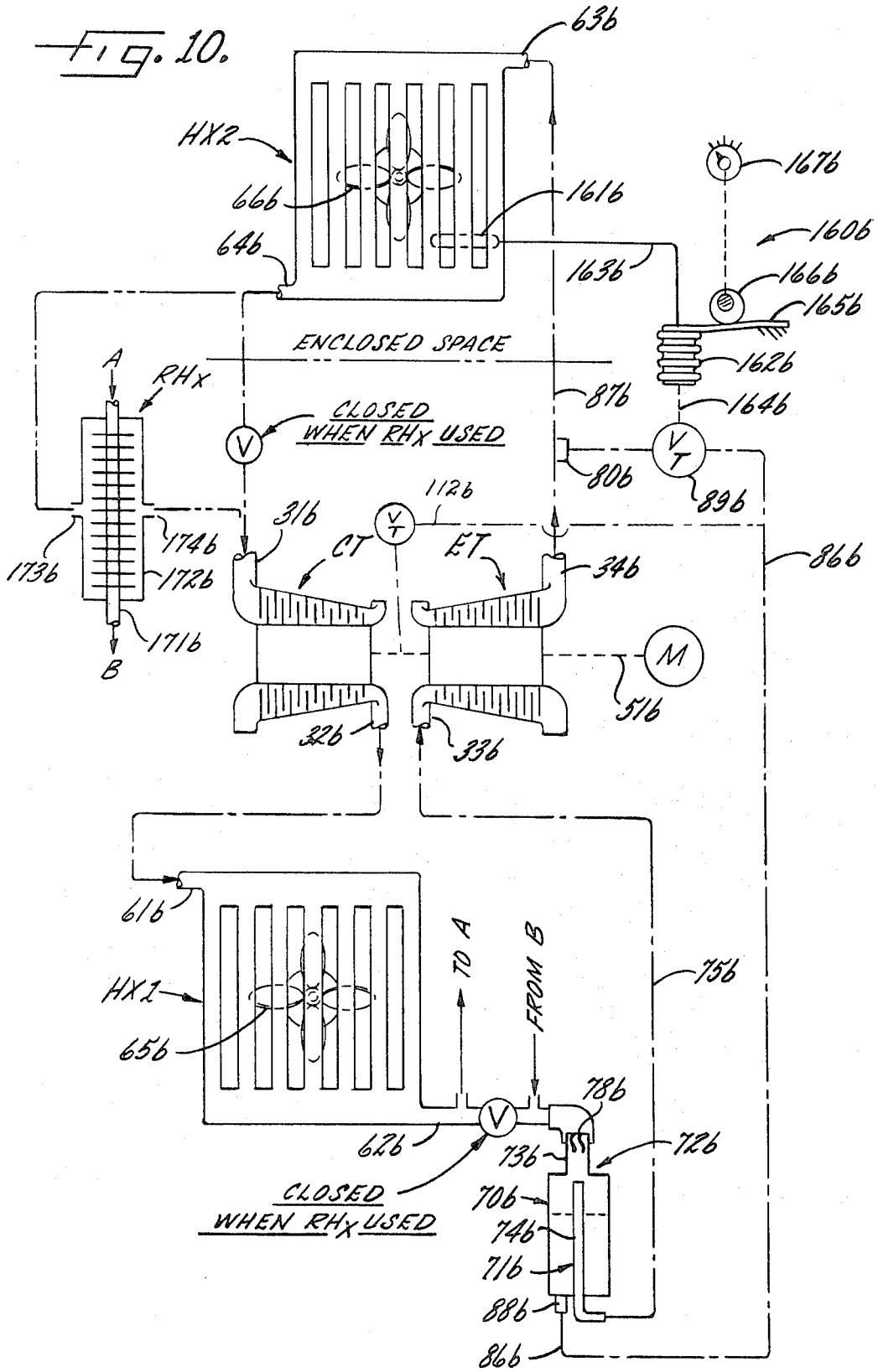

FIG. 10 is a diagram similar to FIG. 8 showing use of turbines in the system.

While the invention has been described in connection with certain preferred embodiments, it will be understood that I do not intend to be limited to the particular embodiments shown but intend, on the contrary, to cover the various alternative and equivalent forms of the invention included within the spirit and scope of the appended claims.

Turning now to FIG. 1 there is shown, in simplified form, an air conditioning system utilizing a compressor-expander 30 which may be constructed as set forth in prior U.S. Pat. No. 3,904,327 which issued on Sept. 9, 1975. It will suffice for present purposes to say that the device includes a vaned rotor rotating in a chamber of elliptical section, the chamber defining a compressor side having inlet and outlet ports 31, 32 and an expander side having inlet and outlet ports 33, 34. The rotor, indicated at 40, has a set of vanes 41–48; the rotor also has a shaft 50 with a drive connection 51 to a motor M.

Connected between the compressor outlet port 32 and the expander inlet port 33 is a primary heat exchanger HX1 having ports 61, 62 and from which heat is liberated. Similarly, connected between the expander outlet port 34 and the compressor inlet port 31, is a secondary heat exchanger HX2, isolated from the first, having ports 63, 64 and in which heat is absorbed. This forms a closed loop charged with a main refrigerant in the form of a gas such as air which is non-condensing at the pressures and temperatures achievable in the unit. In the embodiment of the invention to be described it will be assumed that the system is being used for summer air conditioning, or refrigeration, with the heat exchanger HX2 being thermally coupled to an enclosed space by means of a fan or blower 65. The heat exchanger HX1, on the other hand, is in the ambient atmosphere, with ambient air being driven through it by a fan 66 which may, for example, be the radiator fan of an automobile.

In operation, air, as the refrigerant, and which is drawn in at the inlet port 31, is compressed and experiences an increase in temperature, being discharged in the heat exchanger HX1 where the temperature is restored to the ambient level. The air, still under pressure, is fed to the expander inlet port 33 following which it is permitted to expand accompanied by an abrupt drop in temperature. The cold air is discharged from the outlet port 34 into the secondary heat exchanger HX2 where heat is subtracted from the air fed by the fan 52 into the enclosed space.

In accordance with the present invention there is associated with the outlet of the primary heat exchanger a sump for collection of liquid and there is added to the main refrigerant an auxiliary refrigerant characterized (a) by appreciable heat of vaporization and (b) capability of existing substantially in the liquid state at the pressure and temperature in the primary heat exchanger and capable of evaporation to the vaporous state at the pressure and temperature existing in the secondary heat exchanger, the secondary heat exchanger having a spray nozzle at its inlet, fed from the sump, so that droplets of liquid auxiliary refrigerant are sprayed into the gas discharged from the expander. The auxiliary refrigerant is present in the loop in such excess amount as to collect to a reliably high level in the sump. By reliably high level is meant a level such that for a given adjustment of the spray nozzle, a given range of load conditions, the sump will not run dry. More specifically in accordance with the invention, a combined separator-sump is connected to the output of the primary heat exchanger having means for acting upon the stream of gas to deposit, into the sump, droplets of auxiliary refrigerant entrained in the gas while permitting the gas to pass freely into the inlet port 33 of the expander.

Turning to FIG. 3 the separator-sump indicated at 70, is in the form of a vertically elongated chamber having a sump 71 at the bottom and a separator 72 at the top. Entering the device at the top is a vertically extending pipe 73, while extending upwardly from the sump at the bottom is a stand pipe 74 which merges with an outlet conduit 75. The stand pipe 74 extends at least the major portion of the height of the chamber in axial alignment, and spaced from the wall, to define an annular reservoir space 77. The entry pipe 73 includes a set of helical vanes 78 for creating a swirl or vortex.

Thus, in operation, any droplets of auxiliary refrigerant which are entrained in the gas stream fly outwardly by action of centrifugal force against the wall of the inlet pipe 73, dripping downwardly into the chamber to form a body of liquid refrigerant 70 which occupies the annular space 77. It is desirable to mount the separator-sump at a lower level than the primary heat exchanger for gravity drainage from the latter of any auxiliary refrigerant deposited in liquid form. The stream of gas, on the other hand, passes uninterruptedly between the inlet 73 and the outlet pipe 74, being conveyed via line 75 to the inlet 33 of the expander. The gas which enters the expander has, however, dissolved in it, a small amount of auxiliary refrigerant in vapor form. The separator-sump 70 has been shown in the drawings as somewhat foreshortened; in a practical case it may have a chamber height of eight inches and a diameter of three inches. A simple form of aspirator (not shown) may be used at the outlet 62 of the primary heat exchanger, for example, as disclosed in my prior U.S. Pat. No. 3,967,466, to permit elevated mounting of the separator-sump 70.

For the purpose of spraying auxiliary refrigerant, in the form of finely divided droplets, at the inlet 63 of the secondary heat exchanger HX2, a spray nozzle 80 is used, a typical spray valve construction being set forth in cross section in FIG. 4. The spray nozzle, it will be noted, has a body 81 and an orifice 82 which is occupied by a needle 83 under the control of an adjusting knob 84. Liquid enters at 85, received via a conduit 87 which is supplied from a conduit 86 which in turn is connected to the bottom end of the separator-sump by a fitting 88.

Since the pressure in the primary heat exchanger, and hence in the separator-sump, is substantially higher than the pressure in the secondary heat exchanger, auxiliary refrigerant in liquid form is forced from the sump through the conduit 86, 87 to the spray nozzle 80. The spraying of the auxiliary refrigerant in finely divided form enhances vaporization in the secondary heat exchanger, resulting in a change of state from liquid to vapor form, which change of state may be partial or complete depending upon the degree of volatility of the auxiliary refrigerant. The effect is to drop the temperature at the secondary heat exchanger to a value which is lower than would, on average, exist using the non-condensing gas alone, thereby increasing the heat rate of the system as well as its coefficient of performance. The system thus operates simultaneously in accordance with two different cycles, namely, the reverse-Brayton and reverse-Rankine cycle, with each mode serving to enhance the other to increase cooling effect.

In accordance with one of the aspects of the invention, means are provided for insuring that only auxiliary refrigerant in liquid state flows through the conduit 86, 87. To achieve this, a float-operated check valve is used in the bottom of the sump, the check valve, indicated at 90, having a valve stem 91 which cooperates with a seat 92 on the upper end of the fitting 88. To keep the valve normally open, the valve stem is connected to a float 93, the upward movement thereof being limited by a cage 94. Thus under normal conditions the valve 90 occupies the condition shown in FIG. 3 but, should the level of liquid auxiliary refrigerant 79 drop to a low level, the float 93 loses its floatation, allowing the valve to close, thereby cutting off further flow through conduit 86, 87. Subsequent flow of gas allows the level in the sump to be re-established. The amount of auxiliary refrigerant in the loop is preferably in such excess amount that the level 79 stays reliably high under normal operating conditions. If desired, a sight glass may be provided on the wall of the sump portion 71 for visual display of the level of liquid therein.

In accordance with one of the further aspects of the present invention there is embodied in the compressor-expander unit 30 a path for the flow of cooling and lubricating fluid, and a quantity of lubricating oil is provided in the loop, miscible in the liquid refrigerant in the sump, to form a composite lubricating fluid. A second conduit fed by the sump feeds the lubricating fluid to the lubricant path. A booster pump of the positive displacement type is interposed in at least the second conduit for augmenting the pressure in the conduit thereby to insure a pressure differential producing a reliable lubricant flow.

Turning first to FIG. 2 which shows the unit 30 in axial section and to FIG. 2*a* which shows a typical cross section, the path of the liquid auxiliary refrigerant, generally indicated at 100, has an inlet 101 and an outlet 102, formed concentrically in the shaft 50 of the machine, and which communicates with radial passageways 103, 104, respectively, formed in the rotor sector. The inlet and outlet 101, 102 are provided with suitable couplings (not shown) for connection to stationary lines. The rotor sector is bored to accommodate a hollow cylindrical plug 105 which is sealed to the rotor at its ends and which defines, with the rotor, an annular flow space 106. Heat is efficiently removed from each rotor sector by the refrigerant passing through its flow space. A portion of the liquid refrigerant, rich in oil, may be utilized for direct lubrication of the vanes by providing diversion passages 107, 108 leading from the space to the sector faces.

In the form of the invention illustrated in FIGS. 1 and 2, a complete loop circuit is provided for the lubricating fluid, such loop circuit including a second conduit 112 and a third conduit 113 which serves as a return, the latter being connected to a fitting 114 on the separator-sump 70. A heat exchanger 115, thermally associated with the heat exchanger HX1, is optionally provided in the return line 113. Such heat exchanger is advisable since it insures that the temperature of the returned fluid will be low enough so that the fluid remains in the liquid state until it is discharged in the separator sump, although, if desired, the lubricating-cooling fluid may be at least party vaporized in the rotor.

For augmenting the pressure in the second conduit 112 which carries the lubricating fluid a pump 116 is used. Such pump is preferably of the positive displacement type, chosen in accordance with the desired rate of fluid flow, and is mechanically coupled, by a connection 117, to the same motor M which drives the rotor shaft 50.

The pump 116 may be located as shown, in series with the conduit 86 for supplying not only the conduit 112 which leads to the lubricating system but also for supplying the spray head 80. By operating the spray head at an augmented pressure, more finely divided droplets are produced thereby insuring more rapid evaporation of the auxiliary refrigerant in the secondary heat exchanger. However, if it is desired to keep the size and capacity of the pump 116 as low as possible and if augmented pressure at the spray head is not considered necessary, the pump 116 may be relocated in the system in the lubricant conduit 112 in the position indicated at 116'. It may be noted that where the pump, of positive displacement type, occupies a position 116', it serves to accurately meter the flow of lubricating and cooling fluid through the path 100 in the unit. In any event, since the rate of flow of the liquid is relatively small and since the inlet of the pump is at a relatively high pressure, the pressure differential being relatively low, the pump may be of small size as compared to the other components in the system.

As stated, it is preferable that the oil or equivalent lubricant be miscible with the auxiliary refrigerant so that the two, together, form a composite lubricating and cooling fluid which not only insures minimum wear at the relatively moving surfaces but which insures that heat is effectively carried away, thereby avoiding any possibility that the unit 30 might become overheated, or develop local hot spots, as a result of continued usage at a high heat rate. The term "miscible" is used herein in the general sense of "capable of being mixed". The term therefore covers a first situation where the lubricant is soluble in the auxiliary refrigerant and a second situation where the lubricant is insoluble but may be mixed with the auxiliary refrigerant with the assistance of a wetting or emulsifying agent to form a suspension, for example, a colloidal suspension. The lubricant should preferably have a viscosity between approximately 100 and 1000 centistokes and should be in a concentration on the order of 2 to 30 percent by volume.

In accordance with one of the further aspects of the present invention, means are interposed between the sump and the first conduit (spray nozzle) for increasing the relative concentration of auxiliary refrigerant, and means are interposed between the sump and second conduit (lubricating path) for increase of relative concentration of oil therein. That is to say, while the oil and auxiliary refrigerant, in liquid form, have a dual usage, namely, vaporization on the one hand and lubrication and cooling on the other, it is possible, employing the teachings of the present invention, to alter the relative composition of the composite liquid so that each function is performed to optimum degree. For example of differential concentrator which may be employed to bring about this result reference is made to FIG. 5. Here a concentrator assembly, indicated at 120, has an inlet port 121, a first outlet port 122 and a second outlet port 123 coupled to the corresponding conduits. The device includes a cylindrical wall 124 having end caps 125, 126 held together by a central through-bolt 127. In the discussion which follows it will be assumed that a hydrophobic material, oil, is used as a lubricant and that a hydrophilic material, such as an alcohol, or the like, is employed as the auxiliary refrigerant. By use of materials having these two different characteristics it is possible to choose a filter element which will selectively pass more of the one than of the other. Thus, in series with the spray nozzle line 87 is interposed a cylindrical filter element 131 which is hydrophilic, that is, which has a tendency to pass the auxiliary refrigerant while holding back the particles of oil in minute globular form which are entrained therein, thereby resulting in a relatively high proportion of refrigerant and a relatively low proportion of oil in the first conduit 87 which feeds the spray head. Conversely, a cylindrical filter element 132 is provided in the opposite leg, in series with the second, or lubricating conduit 112, the filter element 132 being hydrophobic (or oleophilic) having a tendency to pass an increased percentage of oil as compared to auxiliary refrigerant. Thus the lubricating and cooling fluid flowing through the second conduit 112, having a higher percentage of oil, will have a higher lubricating efficiency, as suits its intended purpose.

The present invention is not limited to any particular substances for the hydrophilic and hydrophobic filters 131, 132. The hydrophobic element 132 may, for example, consist of cellulosic fibers wound on a spool in criss-cross fashion to achieve porosity, the fibers being coated with a thin layer of non-soluble hydrophobic substance. The hydrophobic element is similarly constructed but uses a coating of non-soluble hydrophilic material. Such elements are available commercially, for example, from Kolar, Inc., 337 Fifth Avenue, Troy, N.Y. 12180.

While the invention is most readily understood by consideration of a concentrator, such as above, having separate filter elements for the respective components the invention may also be practiced by employing a concentrator having a single, selectively acting filter element. The concentrator assembly illustrated in FIG. 6 and indicated generally at 140 has an inlet connection 141 and outlet connections 142, 143. The outlet 143 is fed through a hydrophobic filter element 144 similar to the element 132 described in connection with the preceding embodiment.

The inlet connection 141 is supplied from the second conduit 112 via a line 145 and control valve 146. The composite liquid at the inlet is divided into two portions, the portion which passes through the filter element and the portion which exits directly from the bottom of the device. Since the portion which passes through the filter contains a higher proportion of oil, the material exiting at 142 will contain a correspondingly lower proportion of oil, or higher proportion of refrigerant, which is passed directly through the line 87 to the spray nozzle. The oil-rich liquid exiting at 143, instead of being fed directly into the lubricant conduit 112, is fed to the inlet side of the pump 116 resulting in localized circulation and an increased rate of flow through the filter element 144, with an increase in the percentage of oil occurring during each circuit. The net result is that the material flowing through the first conduit 87, which feeds the spray nozzle, is relatively low in oil, whereas the fluid which feeds into the second or lubricant conduit 112, has a higher percentage of oil befitting its intended use.

The concentrator 140 is preferably provided with a low level check valve 147, similar to the check valve 90 described in connection with FIG. 3 and intended for the same purpose, namely, to insure that only auxiliary refrigerant in liquid form reaches the spray nozzle.

The present invention is not limited to any specific auxiliary refrigerant provided certain conditions are met. These conditions are that the refrigerant shall have appreciable heat of vaporization, that the refrigerant shall be capable of substantial liquifaction at the pressure and temperature existing in the primary heat exchanger, while being substantially converted into vapor form in the secondary heat exchanger, and that the refrigerant shall be in such excess amount in the loop as to collect in liquid form to a reliably high level in the separator-sump under normal running conditions. By "appreciable" heat of vaporization is meant a heat sufficiently high so that addition of the auxiliary refrigerant brings about a worthwhile increase in COP. These conditions are satisfied by one of the lower alcohols, an alcohol which is normally liquid but having a vapor pressure substantially greater than that of water and having five or less carbon atoms, for example, ethyl alcohol, or azeotropes of alcohol and water. The invention may also be practiced by employing as an auxiliary refrigerant fluorocarbons (freons) of the type normally employed in a refrigeration device such as R-11, R-113 or even R-12, R-114. The latter are subject, however, to the disadvantage that such substances, upon leakage, have the harmful effect of degrading the upper atmosphere by removal of ozone therefrom. Still other organic compounds which may be employed as auxiliary refrigerants, either singly or in a compatible mixture, with an inert non-condensing gas include:

| | |
|---|---|
| Trichloromethane | Diethylamine |
| Dichloromethane | Tetramethylsilane |
| Methyl iodid | Isoprene |
| Methanol | 1,3-Pentadiene |
| Carbon disulfide | Tiglaldehyde |
| 1,1-Dichloroethene | 1-Pentene |
| 1-Bromoethylene | 2-Methyl-2-butene |
| Acetaldehyde | 2-Methyl-1-butene |
| Methyl formate | Cyclopentane |
| Ethyl bromide | Pentane |
| Propylamine | 2-Methylbutane |
| 1,2-Butadiene | 2-Methylpentane |
| 2-Butyne | 3-Methylpentane |
| Cyclobutane | 2,2-Dimethylbutane |
| tert-Butyl chloride | 2,3-Dimethylbutane |

Inorganic compounds which may be used include:

| | |
|---|---|
| Boron trichloride | Nitrogen pentoxide |
| Bromine pentafluoride | Silicon tetrachloride |
| Chlorine dioxide | Iodosilane |
| Digermane | Trichlorosilane |
| Molybdenum hexafluoride | Trisilane |
| Nitrogen tetroxide | Disilasane |

While the substance chosen should preferably be sufficiently volatile to evaporate promptly and substantially completely upon spraying through the spray nozzle and traveling through the secondary heat exchanger, use of a less volatile auxiliary refrigerant is not ruled out since any refrigerant which is still in liquid phase will run down the walls of the secondary heat exchanger and may be continuously drained by gravity from the lower header by the simple expedient of placing the outlet 64 of the heat exchanger at a level higher than the compressor inlet port 31. Alternatively a simple form of aspirator (not shown) may be incorporated at the outlet 64 for entraining liquid auxiliary refrigerant in droplet form in the passing stream of gas. Presence of liquid refrigerant in limited quantity in the compressor can actually be desirable because of its sealing and lubricating effect.

While it is preferred to employ a spray nozzle at the secondary heat exchanger positioned at the inlet connection 63 as shown in FIG. 1, it will be understood that the invention may be practiced with the spray nozzle located upstream or downstream of the illustrated position, the main consideration being the depositing of the droplets in the air which flows from the outlet 34 of the expander. The term "at the inlet" is therefore to be given a broad construction and includes positioning the spray valve not only in an upstream position but, in the presently illustrated construction, anywhere within the adjacent (upper) header.

The main refrigerant, in the form of non-condensing gas such as air, should preferably be present in the system in such amount so that its partial pressure, in the secondary heat exchanger, is preferably about atmospheric. While the partial pressure may be as much as two or three times that of the atmosphere, use of such high pressure tends to reduce the effectiveness of the auxiliary refrigerant, inhibiting vaporization of the latter. Consequently, a compromise partial pressure is preferably employed, one only moderately in excess of the atmospheric level.

In practicing the preferred form of the invention, a return line 113 is provided for the lubricating fluid to return the same to the separator-sump. Where this is done a booster pump 116 is required to overcome back pressure and to establish a reliable rate of flow. It will, however, be understood by one skilled in the art that the return line 113 is not essential to the practice of the invention and that the discharge point 102 of the lubricant path 100 may terminate within the unit, with the lubricant fluid being simply entrained in, and removed by, the gas which forms the main refrigerant. Indeed, where the outlet 102 of the lubricant path is terminated within the unit at a point which is at a lower pressure than exists in the separator-sump 70, lubricant fluid will flow through the path without necessity for using a booster pump 116 thereby simplifying the system.

Also, while it is preferred to employ an adjustable spray nozzle 80 for both throttling the secondary refrigerant and converting it to droplet form, thereby making maximum use of the pressure head existing in the supply conduit 87, the throttling and spraying functions may be separated if desired by employing an auxiliary valve 89 (FIG. 1) in series with the nozzle. Indeed, the auxiliary valve 89 may be functionally replaced by making a portion of the conduit 87 in the form of a capillary tube, an expedient widely used in conventional refrigeration systems. In the case of both of the latter alternatives, which provide flow regulation, the needle valve type of spray nozzle 80 may, if desired, be dispensed with so that the fluid flows into the secondary heat exchanger through a nozzle in a stream without intentional division into fine droplets. Such stream may flash into vapor immediately if the partial pressure in the secondary heat exchanger is low or may be deposited upon the walls of the secondary heat exchanger in droplets of larger size for vaporization and carrying away by the high velocity stream of main refrigerant. Thus the term "spray nozzle" shall be understood to be sufficiently broad as to include any vent which terminates conduit 87 regardless of whether a capillary tube or auxiliary valve is incorporated for throttling purposes.

In the preferred form of the invention the separator-sump for separating the liquid auxilary refrigerant from the gas, and for collecting it, is separate from the primary heat exchanger but closely coupled thereto. It will be apparent to one skilled in the art that it is the separating and sump functions which are significant and not necessarily the "outboard" location thereof and consequently, if desired, the sump may be integrated with the primary heat exchanger and the separator function may be performed by impingement of droplets of liquid auxiliary refrigerant on the internal walls thereof, albeit with some sacrifice in separating efficiency, without departing from the invention.

The system described above, and as claimed, provides an increased heat rate and improved coefficient of performance by combining the reverse-Brayton and reverse-Rankine cycles. It is found that a still further improvement can be brought about by the spraying of liquid auxiliary refrigerant in the form of droplets directly into the stream of the main refrigerant passing through the compressor inlet port. This is accomplished by a spray nozzle 150 illustrated in FIG. 7 having an associated throttling valve 150*a* to regulate the rate of flow, the throttling valve being supplied from the sump through an auxiliary conduit 151 which may be fed, for convenience, from the same conduit 87 which supplies the main spray nozzle 80. The nozzle 150 may be of the construction illustrated in FIG. 4. By reason of the evaporation of the droplets of auxiliary refrigerant occurring in the compressor and by reason of the thermal capacity of the droplets, the temperature of the gas in its finally compressed state is lower than what it would be, absent the effect of the spray nozzle 150, thereby bringing about a reduction in the work of compression and thereby reducing the power required to rotate the drive shaft 51. There is a further inherent result; the compressor is kept at a cooler average temperature thereby reducing the need for cooling effect of the fluid which flows through conduit 112 and the lubricant path 100.

The operation of the system described above may be briefly summarized as follows: Entering the compressor inlet 31 is a mixture of gas and auxiliary refrigerant, the latter being either totally or partially varporized in the secondary heat exchanger depending upon the material chosen. Carried along in the stream is a certain amount of oil. The mix is compressed on the compressor side of unit 30 and discharged in the heated and compressed state at outlet 32. The mix flows into the first heat exchanger HX1 where the temperature is reduced to near ambient while the mix is maintained under high pressure, with the cooling causing the auxiliary refrigerant to undergo a change of state to liquid form.

The pressurized and cooled gas, with entrained liquid refrigerant, passes into the upper end of the separator-sump, where the stream is swirled to deposit the entrained liquid particles on the inner wall of the tube 73 from which the liquid drains down to the bottom of the sump 71, collecting therein. The gas, with a certain amount of auxiliary refrigerant vapor dissolved therein passes into the inlet 33 of the expander. As the gas is expanded the temperature drops and the dissolved vapor condenses, with the latter increasing the recovery of the work of expansion. The cold gas is then discharged into the secondary heat exchanger.

At the same time liquid auxiliary refrigerant flowing from the sump and passing through the first conduit 86, 87 is sprayed into the inlet port of the secondary heat exchanger in finely divided form where it totally, or partially, changes state, with the vaporization further reducing the temperature of the secondary heat exchanger for withdrawal of heat at an increased rate from the enclosed space.

The liquid auxiliary refrigerant which flows, via the second conduit 112, into the lubrication path 100 of the unit by reason of the booster pump 116 performs both a lubricating and cooling function, the fluid being returned through auxiliary heat exchanger 115 in line 113 to the sump. Where a differential concentrator is used, as set forth in FIGS. 5 and 6, the fluid following the lubrication path is enriched with oil while the fluid which passes to the spray nozzle 80 contains a decreased percentage of oil. Use of the auxiliary spray head 150 (FIG. 7), by the spraying of liquid auxiliary refrigerant directly into the compressor inlet, performs the supplemental function of further reducing the work of compression to provide a final improvement in coefficient of performance.

While the system has been described with production of "cold" as end result, with the heat in the primary heat exchanger being dissipated to the ambient air, it will be apparent to one skilled in the art that the invention contemplates, as an alternative, use of the system for heating purposes, with the primary heat exchanger being coupled to the enclosed space and the secondary heat exchanger being located in the ambient atmosphere.

The system described above in connection with FIGS. 1 and 2 is distinguished by use of a separate lubricant-cooling path, an auxiliary pump to force fluid around the path, and means for controlling the relative concentration of the lubricant in the path. Reference is now made to FIGS. 8 and 9 which show a somewhat simplified system employing the present invention and in which the same reference numerals are utilized, with addition of subscript "*a*", to denote similar elements. In this embodiment the auxiliary pump is dispensed with, and the conduit 86*a*, which conducts liquid auxiliary refrigerant from the separator-sump 70, leads to a "T" connection 116*a* which divides the flow between two conduits, with a main portion flowing through conduit 87*a* to the spray nozzle 80*a* and a second conduit 112*a* which conducts a minor portion to the compressor-expander 30 for lubrication and cooling purposes. As shown in FIG. 9, the conduit 112*a* is preferably terminated within the housing of the machine at the main bearings, only one of the bearings, however, being illustrated. The pressure in the region of the main bearings is sufficiently below that in the primary heat exchanger, and in the separator-sump, so that sufficient flow occurs through the conduit 112*a* to provide both lubrication and cooling. However, compared to the major flow through the conduit 87*a*, the flow through conduit 112*a* is a relative trickle and, if desired, a manually adjustable throttling valve may be interposed in the conduit 112*a* to limit the flow.

Upon admission of the liquid refrigerant into the machine, to a region having a relatively higher temperature and lower pressure, the liquid refrigerant evaporates to provide efficient cooling, particularly cooling of the rotor and vane assembly in which friction is generated. The vaporized auxiliary refrigerant finds its way through the machine via the incidental working clearances, flowing eventually, and predominantly, to the region of lowest pressure, which is the compressor inlet 31. At this point the vapor resulting from performance of the cooling function, simply joins the inlet stream of gas and auxiliary refrigerant flowing into the compressor inlet from the secondary heat exchanger. In contrast with the system shown in FIG. 1, no return line, such as that shown at 113, is required for the cooling and lubricating stream.

One of the results of the vaporization of the liquid refrigerant entering via line 112*a* is that is liberates the transported lubricant in a relatively concentrated form. This lubricant permeates the machine and is constantly renewed at all of the frictional surfaces. Any excess lubricant which may tend to collect is discharged, in droplet form, through the compressor outlet port 32 where it rejoins, in miscible form, the auxiliary refrigerant. No lubricant concentration (120,140) need be used.

In accordance with one of the aspects of the present invention a thermostat is provided for correctively adjusting the rate of flow of liquid auxiliary refrigerant to the spray nozzle thereby to vary the heat rate of the system as a whole for maintenance of temperature at a set point. Thus I provide a thermostat 160 having a responsive element in the form of a bulb 161 and an output member in the form of a bellows 162, the bulb and bellows being interconnected by a capillary 163. The output member of the thermostat includes a mechanical link 164 connected to the throttle valve 89*a* in line 87*a* which carries the liquid refrigerant. To control the set point of the thermostat, the bellows is mounted upon an arm 165 engaged by a cam 166 having a manual setting knob 167. The bulb may be mounted so that it is subject to the air stream through the secondary heat exchanger or it may be mounted elsewhere in the enclosed space.

In operation an equilibrium flow of liquid refrigerant through line 87*a* is promply established. In the event the temperature of the bulb 161 rises, calling for cold, the bellows 162 expands for incremental opening of the throttle valve 89*a* causing additional liquid to pass through line 87*a* to increase the heat rate of the system, thereby restoring the temperature of the bulb to the set point. Conversely, when the temperature of the bulb falls below the set point, this produces contraction at the bellows and a throttling down of the flow of liquid refrigerant through the valve 89*a*, reducing the heat rate of the system, thereby permitting the temperature to again rise to the set point.

Since the thermostat directly controls only the auxiliary refrigerant, and since the flow of the main refrigerant, air, remains unaffected, a trimming or vernier type of control is exercised resulting in a high degree of precision. The liquid refrigerant which is held back by increased throttling action is simply retained in the sump, increasing the level in the sump slightly, where it remains until the system calls for a greater rate of flow. The effect is to controllably and correctively increase the amount of auxiliary refrigerant actively at work within the system at any given time by controlling its rate of flow. In the present system there is no risk in developing a condition of starvation on the one hand and slugging on the other, which would constitute serious risks if this system of control were to be employed in a conventional refrigeration system employing a volatile refrigerant such as freon.

In operation, cooling effect is produced in the secondary heat exchanger by a combination of the expansion of the non-condensing gas and vaporization of the liquid auxiliary refrigerant. A mix of the gas and vapor from the outlet 64*a* of the secondary heat exchanger enters the compressor inlet port 31*a*. As a result of the compression, the mixture leaving the compressor at its outlet port 32*a* will be at a high pressure, approximately 2.5 to 4 times the pressure at the inlet, and at a high temperature, high enough to provide super heat. The temperature is reduced in the primary heat exchanger HX1, condensing the auxiliary refrigerant which forms droplets in the air stream and which, to some extent, runs down the walls of the primary heat exchanger. As a result of gravity drainage and the action of the swirler 78*a*, liquid refrigerant collects in the sump 71*a* whereas the gas, in saturated condition, flows uninterruptedly through line 75*a* to the inlet 33*a* of the expander. Expansion results in recovery of energy, with the chilled air flowing through output 34*a* past the spray nozzle 80*a* and into the secondary heat exchanger.

At the same time liquid refrigerant flowing through line 86*a*, 87*a*, suitably throttled in the valve 89*a*, is sprayed into the air stream at the nozzle 80*a* where, because of a drop in pressure, the liquid refrigerant undergoes the complete or partial change of state, providing additional cooling effect, that is, absorbing additional heat, in the secondary heat exchanger, thereby completing the cycle.

The minor portion of the flow of liquid refrigerant through the "T" connection 116a and via conduit 112a, enters the compressor-expander at an inlet connection 101a (FIG. 9), in the region of the main bearings, vaporizing to provide a cooling effect to counteract the heat of friction within the machine while, at the same time, liberating concentrated lubricant to minimize the amount of friction. The resulting vapor seeks a path to the region of lowest pressure within the machine, which is the compressor inlet port 31a where it joins the main stream for eventual return to the separator-sump.

In accordance with a still further feature of the present invention a regenerative heat exchanger is used having channels which are thermally coupled and interposed at the respective outlets of the primary and secondary heat exchangers. The regenerative heat exchanger, indicated at RHX in FIG. 8, has a central conduit 171, defining a first channel, surrounded by a housing 172, which forms a second channel having inlet and outlet ports 173, 174. In use, the port 173 is connected to the outlet 64a of the secondary heat exchanger while the port 174 is connected to the inlet port 31a of the compressor. The conduit 171 has its first end, indicated at A, connected to the outlet 62a of the primary heat exchanger and its second end, indicated at B, connected to the end inlet of the separator-sump. Such a regenerative heat exchanger is particularly useful where large differences in temperature exist between the enclosed space and the ambient as, in a refrigeration use, where low temperatures are achieved in the enclosed space. Because of the thermal coupling, the effect is to warm up the gas entering the compressor and to cool off the gas entering the expander. As a result, the gas leaving the compressor is at a higher temperature, increasing the temperature differential in the primary heat exchanger and thereby increasing the rate of heat loss in the primary heat exchanger, causing its efficiency to be increased. Moreover, the gas which enters the expander enters at a lower temperature, causing the gas, upon expansion, to be at a lower temperature thereby increasing the temperature differential at the secondary heat exchanger to increase its rate of absorption of heat and thereby increasing its efficiency. In short, considering the entire system as a heat pump, greater pumping heights are achievable where the regenerative heat exchanger is included as part of the system.

It is one of the features of the present invention that the auxiliary refrigerant be one that is capable of existing in vapor form in the secondary heat exchanger and capable of liquifaction at the temperature and pressure existing at the output of the primary heat exchanger. However, it will be understood that all of the auxiliary refrigerant need not be in the respectively vaporous and liquid states; it is deemed sufficient that a predominant portion exists in such states. For example, it is not essential in the practice of the invention that all of the droplets sprayed into the inlet of the secondary heat exchanger be converted to vaporous form as long as some means are provided for draining from the secondary heat exchanger any unconverted droplets, as earlier described.

The term "auxiliary refrigerant" in the simplest form of the invention refers to a single added substance which may, for example, be pentane. However, the term is not limited thereto and includes within its scope a mixture of added substances, as, for example, a mixture of freons, e.g., R-11 and 113, provided that elements of the mix are capable of existing in the vapor state in the secondary heat exchanger and in the liquid state in the primary heat exchanger; in other words, provided that elements of the mix change state in accordance with the reverse-Rankine cycle.

Reference has also been made to utilization of the auxiliary refrigerant for cooling and lubricating purposes. In certain portions of the specification and certain of the claims emphasis has been on lubrication whereas in other portions of the specification and claims emphasis has been upon cooling. However, it will be understood that the lubricating and cooling functions are so closely related that the terms "cooling" fluid and "lubricating" fluid are, for practical purposes, interchangeable.

While it is preferred to practice the invention as set forth in FIG. 8 utilizing a compressor-expander of the type in which the vanes form enclosed compartments for positive compression and expansion as the shaft rotates, the invention is, in its broader aspects, not limited thereto; on the contrary, the invention contemplates use of turbines for the compressor and expander having their rotor vanes coupled to a common shaft. Such a system is illustrated in FIG. 10 where the same reference numerals are employed as in FIG. 8 but with addition of subscript b. In this system the compressor function is performed by a compressor turbine CT having an inlet 31b and outlet 32b and the expanding function is performed by expanding turbine ET having an inlet port 33b and outlet port 34b. The compressor and expander include a housing having an inner wall defining chamber means with rotors rotatable therein. The rotors have vanes for respective compression and expansion connected to a common shaft 51b.

While the turbines have not been set forth in mechanical detail, it will be understood that the turbines are of a type commercially available, the turbine CT, for example, being capable of accepting a non-condensing gas such as air at atmospheric pressure or above and compressing it so that it exits at a pressure substantially greater, preferably two to four times greater, than the pressure at the inlet. The converse takes place in the expansion turbine from which the gas is discharged at substantially the original inlet pressure. Since the average temperature of the gas is less in the turbine ET than it is in the turbine CT, the turbine ET may be correspondingly scaled down in volumetric size, a matter within the skill of the art.

The operation of the system of FIG. 10 is analogous to that in FIG. 8 previously described. A mixture of the non-condensing gas plus gaseous auxiliary refrigerant, preferably above atmospheric pressure, is fed to the inlet port 31b of the turbine CT where it is compressed to a pressure which depends upon the compression ratio of the turbine at operating speed. The mix, flowing from the outlet port 32b, is cooled in the primary heat exchanger HX1 causing condensation of the auxiliary refrigerant which is carried along in droplet form by the stream of gas with separation occurring, as described, in the separator-sump 70b. The gas flows freely through the separator and through line 75b into the inlet port 33b of the expander turbine ET which expands the gas to its original pressure resulting in a drop in temperature, there being discharged into the secondary heat exchanger. Simultaneously, auxiliary refrigerant in liquid form flows from the sump through line 86b into spray head 80b where it is formed into droplets which are sprayed into the stream of gas flowing through the line 87b for evaporation both in the line and in the secondary heat exchanger for absorption of additional heat.

Thus, just as in the previous embodiment, the gas completes a reverse-Brayton cycle while the auxiliary refrigerant completes a reverse-Rankine cycle with the end result of the two cycles being cooperative cooling effect in the secondary heat exchanger. Alternatively, where the system is employed as a heat pump the two cycles produce heat jointly in the primary heat exchanger, the result in either event being a striking increase in coefficient of performance above that obtainable by either of the cycles operating alone.

Where close-coupled turbines are used as in FIG. 10, the central bearing may be simultaneously cooled and lubricated by lubricant-containing auxiliary refrigerant flowing through supply line 112b with the rate of flow controlled by throttling and with the vaporized material finding its way out of the structure through outlet port 34b analogously to the arrangement illustrated in FIGS. 8 and 9.

In practicing the invention in its preferred embodiment a single separator-sump 70, 70a, 70b is disclosed where separating the auxiliary refrigerant plus lubricant in liquid form from the main refrigerant. However, the invention is not limited thereto. A separate separator-sump of the type 70 may be interposed at the outlet port 32, 32a, 32b of the compressor for the purpose of solely intercepting lubricant from the refrigerants which are, at that point, both in vapor form, the sump being then connected by a suitable conduit to the bearings of the device. Where the lubricant is thus intercepted substantially pure auxiliary refrigerant, in liquid form, will be collected at the separator-sump associated with the primary heat exchanger for transmittal, again through a suitable conduit, to the spray nozzle which feeds the secondary heat exchanger.

What is claimed is:

1. In an air conditioning system, an air conditioning unit comprising a compressor and an expander, the compressor and expander including a housing having an inner wall defining chamber means with rotor means rotatable therein, the rotor means having vanes for compression and expansion connected to a common shaft, the compressor and expander each having an inlet port and an outlet port, a primary heat exchanger connected between the compressor outlet port and the expander inlet port, a secondary heat exchanger between the expander outlet port and the compressor inlet port to form a closed loop, the heat exchangers being isolated from one another, the loop being charged with a main refrigerant in the form of a gas which is non-condensing at temperatures and pressures encountered in the unit so that upon driving of the rotor means the gas (1) is compressed and heated in the compressor, (2) releases heat in the primary heat exchanger, (3) is expanded and cooled in the expander, and (4) absorbs heat in the secondary heat exchanger, an auxiliary refrigerant in the loop, the auxiliary refrigerant being one (a) having an appreciable heat of vaporization and (b) capable of existing substantially in the liquid state at the pressure and temperature in the primary exchanger and in the vapor state in the secondary heat exchanger, the primary heat exchanger having an associated sump for collection of liquid auxiliary refrigerant while permitting the non-condensing gas to pass freely into the expander, a spray nozzle at the inlet of the secondary heat exchanger, a conduit connected to the sump and terminating at the spray nozzle so that liquid auxiliary refrigerant collected in the sump is sprayed into the gas discharged from the expander for vaporization at the secondary heat exchanger for absorption of additional heat therein, the auxiliary refrigerant being present in such excess amount as to collect in the sump to a reliably high level under normal running conditions to insure that auxiliary refrigerant entering the conduit is in liquid form.

2. In an air conditioning system, an air conditioning unit comprising a compressor and an expander, the compressor and expander including a housing having an inner wall defining chamber means with rotor means rotatable therein, the rotor means having vanes for compression and expansion connected to a common shaft, the compressor and expander each having an inlet port and an outlet port, a primary heat exchanger connected between the compressor outlet port and the expander inlet port, a secondary heat exchanger between the expander outlet port and the compressor inlet port to form a closed loop, the heat exchangers being isolated from one another, the loop being charged with a main refrigerant in the form of a gas which is non-condensing at temperatures and pressures encountered in the unit so that upon driving of the rotor means the gas (1) is compressed and heated in the compressor, (2) releases heat in the primary heat exchanger, (3) is expanded and cooled in the expander, and (4) absorbs heat in the secondary heat exchanger, an auxiliary refrigerant in the loop, the auxiliary refrigerant being one (a) having an appreciable heat of vaporization and (b) capable of existing substantially in the liquid state at the pressure and temperature existing in the primary heat exchanger and in the vapor state and the pressure and temperature in the secondary heat exchanger, a separator-sump interposed between the primary heat exchanger and the expander inlet port including a separator which permits the non-condensing gas to pass freely to the expander while intercepting and diverting auxiliary refrigerant in liquid form and including a sump for collecting the diverted auxiliary refrigerant, a spray nozzle at the inlet of the secondary heat exchanger having a conduit for coupling the same to the sump so that auxiliary refrigerant in liquid form is drawn from the sump sprayed into the gas discharged from the expander for evaporation at the secondary heat exchanger for absorption of additional heat therein, the auxiliary refrigerant being present in such excess amount as to collect in the sump to a reliably high level under normal running conditions to insure that the auxiliary refrigerant entering the conduit is in liquid form.

3. In an air conditioning system, an air conditioning unit comprising a compressor and an expander, the compressor and expander including a housing having an inner wall defining chamber means with rotor means rotatable therein, the rotor means having vanes for compression and expansion connected to a common shaft, the housing providing a path for cooling fluid fed by a cooling connection, the compressor and expander each having an inlet port and an outlet port, a primary heat exchanger connected between the compressor outlet port and the expander inlet port and having an associated separator sump for drainage of liquid thereto, a secondary heat exchanger between the expander outlet port and the compressor inlet port to form a closed loop, the heat exchangers being isolated from one another, the loop being charged with a main refrigerant in the form of a gas which is non-condensing at temperatures and pressures encountered in the unit so that upon driving of the rotor means the gas (1) is compressed and heated in the compressor, (2) releases heat in the primary heat exchanger, (3) is expanded and cooled in the expander, and (4) absorbs heat in the secondary heat exchanger, an auxiliary refrigerant in the loop, the auxiliary refrigerant being one (a) having an appreciable heat of vaporization and (b) capable of existing substantially in the liquid state at the pressure and temperature existing in the primary heat exchanger and in the vapor state at the pressure and temperature in the secondary heat exchanger, the separator-sump being so constructed as to permit the non-condensing gas to pass freely to the expander while auxiliary refrigerant is collected therein in liquid form, a spray nozzle at the inlet of the secondary heat exchanger, a first conduit connected to the sump for conducting liquid auxiliary refrigerant therefrom to the spray nozzle so that liquid auxiliary refrigerant is sprayed into the gas from the expander for evaporation at the secondary heat exchanger for absorption of additional heat therein, the auxiliary refrigerant being present in such excess amount as to collect in the sump to a reliably high level, a second conduit connected to receive auxiliary refrigerant from the sump and for feeding it to the cooling connection, and means for controlling the relative flow in the conduits so that the rate of flow in the second conduit is only a small fraction of the rate of flow in the first conduit.

4. In an air conditioning system, an air conditioning unit comprising a compressor and an expander, the compressor and expander including a housing having an inner wall defining chamber means with rotor means rotatable therein, the rotor means having vanes for compression and expansion connected to a common shaft, the housing providing a path for lubricating fluid fed by a lubricant connection, the compressor and expander each having an inlet port and an outlet port, a primary heat exchanger connected between the compressor outlet port and the expander inlet port, a secondary heat exchanger between the expander outlet port and the compressor inlet port to form a closed loop, the heat exchangers being isolated from one another, the loop being charged with a main refrigerant in the form of a gas which is non-condensing at temperatures and pressures encountered in the unit so that upon driving of the rotor means the gas (1) is compressed and heated in the compressor, (2) releases heat in the primary heat exchanger, (3) is expanded and cooled in the expander, and (4) absorbs heat in the secondary heat exchanger, an auxiliary refrigerant in the loop, the auxiliary refrigerant being one (a) having an appreciable heat of vaporization and (b) capable of existing substantially in the liquid state at the pressure and temperature existing in the primary heat exchanger and in the vapor state in the secondary heat exchanger, a sump associated with the primary heat exchanger for collecting auxiliary refrigerant in liquid form while permitting the non-condensing gas to pass freely to the expander inlet port, a quantity of lubricating oil in the loop miscible in the liquid refrigerant in the sump to form a lubricating fluid, a spray nozzle at the inlet of the secondary heat exchanger, a first conduit connected to the sump for conducting liquid auxiliary refrigerant therefrom to the spray nozzle so that liquid auxiliary refrigerant is sprayed into the gas from the expander for evaporation at the secondary heat exchanger for absorption of additional heat therein, the auxiliary refrigerant being present in such excess amount as to collect in the sump to a reliably high level, a second conduit connected between the sump and the lubricant connection for feeding lubricating fluid to the latter, and a booster pump interposed in at least the second conduit for augmenting the pressure in such conduit.

5. In an air conditioning system, an air conditioning unit comprising a compressor and an expander, the compressor and expander including a housing having an inner wall defining chamber means with rotor means rotatable therein, the rotor means having vanes for compression and expansion connected to a common shaft, the housing having a path for cooling-lubricating fluid terminating in inlet and outlet connections, the compressor and expander each having an inlet port and an outlet port, a primary heat exchanger connected between the compressor outlet port and the expander inlet port, a secondary heat exchanger between the expander outlet port and the compressor inlet port to form a closed loop, the heat exchangers being isolated from one another, the loop being charged with a main refrigerant in the form of a gas which is non-condensing at temperatures and pressures encountered in the unit so that upon driving of the rotor means the gas (1) is compressed and heated in the compressor, (2) releases heat in the primary heat exchanger, (3) is expanded and cooled in the expander, and (4) absorbs heat in the secondary heat exchanger, an auxiliary refrigerant in the loop, the auxiliary refrigerant being one (a) having an appreciable heat of vaporization and (b) capable of existing substantially in the liquid state at the pressure and temperature existing in the primary heat exchanger and in the vapor state in the secondary heat exchanger, a sump associated with the primary heat exchanger for collecting auxiliary refrigerant in liquid form while permitting the non-condensing gas from the primary heat exchanger to pass freely to the expander in liquid form, a quantity of lubricating oil in the loop miscible in the liquid refrigerant in the sump to form a lubricating fluid, a spray nozzle at the inlet of the second heat exchanger, a first conduit connected to the sump and terminating at the spray nozzle so that liquid auxiliary refrigerant is sprayed into the gas discharged from the expander for vaporization at the secondary heat exchanger for absorption of additional heat therein, a second conduit fed by the sump and terminating at the inlet connection, and a third conduit for returning the cooling-lubricating fluid from the outlet connection to the sump, a positive displacement booster pump being interposed in series with at least the second conduit for metering the flow of fluid through the cooling-lubricating path.

6. In an air conditioning system, an air conditioning unit comprising a compressor and an expander, the compressor and expander including a housing having an inner wall defining chamber means with rotor means rotatable therein, the rotor means having vanes for compression and expansion connected to a common shaft, the compressor and expander each having an inlet port and an outlet port, a primary heat exchanger connected between the compressor outlet port and the expander inlet port, a secondary heat exchanger between the expander outlet port and the compressor inlet port to form a closed loop, the heat exchangers being isolated from one another, the loop being charged with a main refrigerant in the form of a gas which is non-condensing at temperatures and pressures encountered in the unit so that upon driving of the rotor means the gas (1) is compressed and heated in the compressor, (2) releases heat in the primary heat exchanger, (3) is expanded and cooled in the expander, and (4) absorbs heat in the secondary heat exchanger thereby completing a reverse-Brayton cycle, an auxiliary refrigerant in the loop, the auxiliary refrigerant being one (a) having an appreciable heat of vaporization and (b) capable of existing substantially in the liquid state at the pressure and temperature existing in the primary heat exchanger and in the vapor state in the secondary heat exchanger, means including a sump associated with the primary heat exchanger for collection of liquid auxiliary refrigerant while permitting the non-condensing gas to pass freely to the expander, means including a conduit for conducting liquid auxiliary refrigerant from the sump to the secondary heat exchanger resulting in evaporation for absorption of additional heat therein and thereby completing a reverse-Rankine cycle.

7. The combination as claimed in claim 1 or claim 2 or claim 3 or claim 4 or claim 5 or claim 6 in which the inner wall of the chamber means is eccentric with respect to the shaft and in which the vanes are radially mounted on the rotor means to sealingly engage the inner wall to define enclosed compartments which become smaller in the compressor and larger in the expander for positive compression and expansion as the shaft rotates.

8. The combination as claimed in claim 1 or claim 2 or claim 3 or claim 4 or claim 5 or claim 6 in which the compressor and expander are in the form of turbines having their rotor vanes coupled to a common shaft.

9. The combination as claimed in claim 1 or claim 2 or claim 3 or claim 4 or claim 5 or claim 6 in which the sump is at a lower level than the primary heat exchanger for constant gravity drainage from the primary heat exchanger into the sump of auxiliary refrigerant in liquid form.

10. The combination as claimed in claim 1 or claim 2 or claim 3 or claim 4 or claim 5 or claim 6 in which the secondary heat exchanger is so constructed and arranged with respect to the compressor that any auxiliary refrigerant still in liquid form in the secondary heat exchanger flows therefrom with the stream of gas to the compressor to perform a sealing function therein.

11. The combination as claimed in claim 5 in which a lubricant heat exchanger is interposed in the third conduit, the lubricant heat exchanger being thermally associated with the primary heat exchanger.

12. The combination as claimed in claim 2 or claim 3 in which the separator-sump has a housing enclosing a vertically elongated chamber, having an inlet at the top and an outlet at the bottom, an inlet pipe coupled to the inlet and a stand pipe coupled to the outlet, the pipe being axially alined and spaced from one another, the stand pipe extending from the bottom of the chamber, a major portion of the height thereof to form a surrounding reservoir, means for creating a vortex in the inlet pipe for the purpose of centrifugal discharge of droplets of liquid auxiliary refrigerant entrained in the entering stream of gas for retention of the liquid auxiliary refrigerant in the reservoir while the gas passes freely through the stand pipe and into the expander.

13. The combination as claimed in claim 1 or claim 2 or claim 3 or claim 4 or claim 5 of claim 6 in which means are provided sensitive to the existence of liquid auxiliary refrigerant in the sump for insuring that auxiliary refrigerant in liquid form only flows from the sump for passage to the secondary heat exchanger.

14. The combination as claimed in claim 1 or claim 2 or claim 3 or claim 4 or claim 5 or claim 6 in which the non-condensing gas is air.

15. The combination as claimed in claim 4 or claim 5 in which the booster pump is in series with both the first and second conduits.

16. The combination as claimed in claim 1 or claim 2 or claim 3 or claim 4 or claim 5 in which the auxiliary refrigerant is sufficiently volatile to evaporate substantially completely in the secondary heat exchanger.

17. The combination as claimed in claim 1 or claim 2 or claim 3 or claim 4 or claim 5 or claim 6 in which the auxiliary refrigerant is taken from the group comprising: Trichloromethane, Dichloromethane, Methyl iodid, Methanol, Carbon disulfide, 1,1-Dichloroethene, 1-Bromoethylene, Acetaldehyde, Methyl formate, Ethyl bromide, Propylamine, 1,2-Butadiene, 2-Butyne, Cyclobutane, tert-Butyl chloride, Diethylamine, Tetramethylsilane, Isoprene, 1,3-Pentadiene, Tiglaldehyde, 1-Pentene, 2-Methyl-2-butene, 2-Methyl-1-butene, Cyclopentane, Pentane, 2-Methylbutane, 2-Methylpentane, 3-Methylpentane, 2,2-Dimethylbutane, 2,3-Dimethylbutane.

18. The combination as claimed in claim 1 or claim 2 or claim 3 or claim 4 or claim 5 or claim 6 in which the auxiliary refrigerant is taken from the group comprising: Boron trichloride, Bromine pentafluoride, Chlorine dioxide, Digermane, Molybdenum hexafluoride, Nitrogen tetroxide, Nitrogen pentoxide, Silicon tetrachloride, Iodosilane, Trichlorosilane, Trisilane, Disilasane.

19. The combination as claimed in claim 1 or claim 2 or claim 3 or claim 6 in which there is a charge of lubricating oil in the loop which circulates with the main and auxiliary refrigerants.

20. The combination as claimed in claim 1 or claim 2 or claim 3 or claim 4 or claim 5 or claim 6 including an auxiliary spray nozzle at the inlet of the compressor, and an auxiliary conduit connected to the sump and terminating at the auxiliary spray nozzle so that droplets of liquid auxiliary refrigerant are sprayed into the gas discharged from the second heat exchanger and entering the compressor.

21. The combination as claimed in claim 1 or claim 2 or claim 3 or claim 4 or claim 5 or claim 6 including a thermostat associated with one of the heat exchangers, the thermostat having a responsive element and an output member, and adjustable valve for controlling the rate of flow of liquid refrigerant from the sump, the output member of the thermostat being coupled to the valve so that a change in the temperature at the responsive element brings about a corrective change in fluid flow, and hence in the heat rate, for maintenance of a substantially predetermined temperature at the responsive element.

22. The combination as claimed in claim 1 or claim 2 or claim 3 or claim 4 or claim 5 or claim 6 including a regenerative heat exchanger having first and second fluid channels sealed with respect to one another yet thermally coupled together, the channels being interposed at the respective outlets of the primary and secondary heat exchangers.

23. The combination as claimed in claim 4 or claim 5 in which means are interposed between the sump and the second conduit for increasing the relative concentration of oil flowing through the second conduit.

24. The combination as claimed in claim 4 or claim 5 in which means are interposed between the sump and the first conduit for increasing the relative concentration of the auxiliary refrigerant flowing through the first conduit and means are interposed between the sump and the second conduit for increasing the relative concentration of oil flowing through the second conduit.

25. The combination as claimed in claim 1 or claim 2 or claim 3 or claim 4 or claim 5 or claim 6 in which there is sufficient non-condensing gas confined in the loop so that the partial pressure of the non-condensing gas in the secondary heat exchanger is about at atmospheric level.

* * * * *